United States Patent [19]

Beck

[11] Patent Number: 5,007,555

[45] Date of Patent: Apr. 16, 1991

[54] BIASED HINGE CAP

[75] Inventor: James M. Beck, Carol Stream, Ill.

[73] Assignee: Creative Packaging Corp., Wheeling, Ill.

[21] Appl. No.: 452,427

[22] Filed: Dec. 19, 1989

[51] Int. Cl.[5] ..... B65D 47/08

[52] U.S. Cl. ..... 220/339; 220/335; 215/235

[58] Field of Search ..... 220/339, 335, 338; 215/235, 236, 237, 306

[56] References Cited

U.S. PATENT DOCUMENTS

| | | | |
|---|---|---|---|
| 4,220,248 | 9/1980 | Wilson et al. | 215/235 |
| 4,377,247 | 3/1983 | Hazard et al. | 222/517 |
| 4,403,712 | 9/1983 | Wiesinger | 220/339 |
| 4,414,705 | 11/1983 | Ostrowsky | 16/225 |
| 4,503,991 | 3/1985 | Joyce | 220/339 |
| 4,638,916 | 1/1987 | Beck et al. | 215/235 |
| 4,726,091 | 2/1988 | Joyce | 16/227 |
| 4,793,501 | 12/1988 | Beck | 215/235 |
| 4,793,502 | 12/1988 | Beck | 215/235 |
| 4,832,219 | 5/1989 | Nycz | 215/235 |
| 4,848,612 | 7/1989 | Beck | 215/235 |
| 4,854,473 | 8/1989 | Dubach | 220/335 |
| 4,915,268 | 4/1990 | Lay et al. | 222/498 |

*Primary Examiner*—Stephen Marcus
*Assistant Examiner*—Vanessa M. Roberts
*Attorney, Agent, or Firm*—Silverman, Cass & Singer, Ltd.

[57] ABSTRACT

A unitary shielded snap type hinge closure including a cap body portion adapted to be secured to a container having a dispending opening therein. The cap body portion includes a top portion raised above a shoulder and a periphery therearound and includes a mating portion. A lid is hinged to the cap body by a solid one-piece unitary hinge member integrally formed between the cap body and the lid, the hinge member being attached on one side directly to the lid and on an opposite side to the cap body by a film hinge and including a central planar portion. The hinge member includes a side shoulder depending from either side of the central planar portion of the hinge member when the lid is in its opened position and being attached on one end directly to the lid and on an opposite end to the cap body by said film hinge so that a snap is provided in the side shoulders during operation of the hinge member and the side shoulders mate with the mating portion of the cap body in a closed position of the lid to inhibit contamination and reduce seepage around the hinge closure.

16 Claims, 7 Drawing Sheets

BIASED HINGE CAP

BACKGROUND OF THE INVENTION

This invention relates generally to hinge closures for dispensing containers, and more particularly, to such a hinge closure which is shielded to minimize seepage of product and contamination under the cap and includes a snap open feature to snap the closure lid open and hold the lid away from the dispensing orifice when in such open condition.

Dispensing containers usually have one of two types of closures. One such closure comprises a spout mounted to be movable between open and closed positions. A second type of closure includes a pivotally mounted lid capable of being moved between a closed and an open dispensing position. The lid covers the dispensing opening in the closed position; the lid is positioned away from the opening in the open position to allow the product in the container to be dispensed.

A particularly useful type of pivotally mounted lid includes a mechanism to maintain the lid in the closed or open position without an outside retaining or restraining force. An example of such a closure is disclosed, for example, in U.S. Pat. No. 4,793,502 which is in the name of the Applicant of the present application and is hereby incorporated herein by reference. In that closure the lid generally is secured in the closed position by a first mechanism, such as by a friction type fit onto the closure, and is maintained in the open position away from the dispensing opening by a second mechanism, such as a snap open type hinge.

It also is advantageous to provide a hinged lid closure that reduces leakage and contamination in and around the lid and hinge member when the lid is closed onto the cap body. An example of such a closure is disclosed, for example, in U.S. Pat. No. 4,793,501 which is in the name of the Applicant of the present invention and is hereby incorporated herein by reference. These types of hinges, however, typically do not include the desired snap open feature as described above.

It therefore is desirable to provide a hinged closure with a snap open feature that is integrally formed with the cap body as a unitary one-piece hinge, permits minimal product seepage and reduces contamination in and around the lid and hinge area when the lid is closed onto the cap body.

SUMMARY OF THE INVENTION

The above and other disadvantages of the prior art dispensing closures are overcome in accordance with the present invention by providing a unitary shielded snap type hinge closure. The closure includes a cap body portion adapted to be secured to a container having a dispensing opening therein and including a top portion raised above a shoulder and a periphery therearound and includes a mating portion. A lid is hinged to the cap body by a solid one-piece unitary hinge member integrally formed between the cap body and the lid, the hinge member being attached on one side directly to the lid and on an opposite side to the cap body by a film hinge and including a central planar portion. The hinge member includes a side shoulder depending from either side of the central planar portion of the hinge member when the lid is in its opened position and being attached on one end directly to the lid and on an opposite end to the cap body by said film hinge so that a snap is provided in the side shoulders during operation of the hinge member and the side shoulders mate with the mating portion of the cap body in a closed position of the lid to inhibit contamination and reduce seepage around the hinge closure.

DESCRIPTION OF THE PREFERRED EMBODIMENTS

Figure 1:
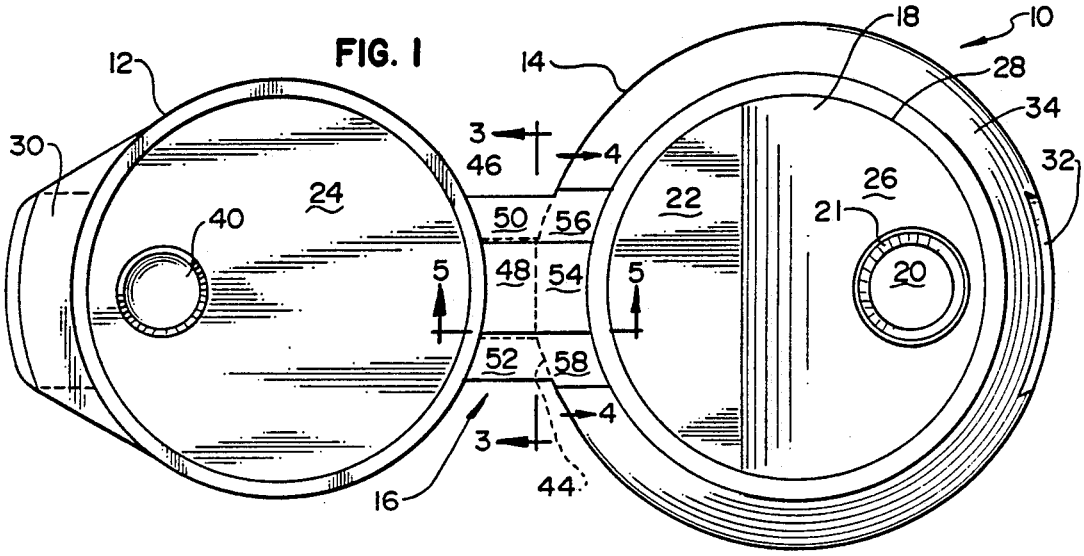
FIG. 1 is a top plan view of one embodiment of a hinge closure of the invention shown in open position.
Figure 2:
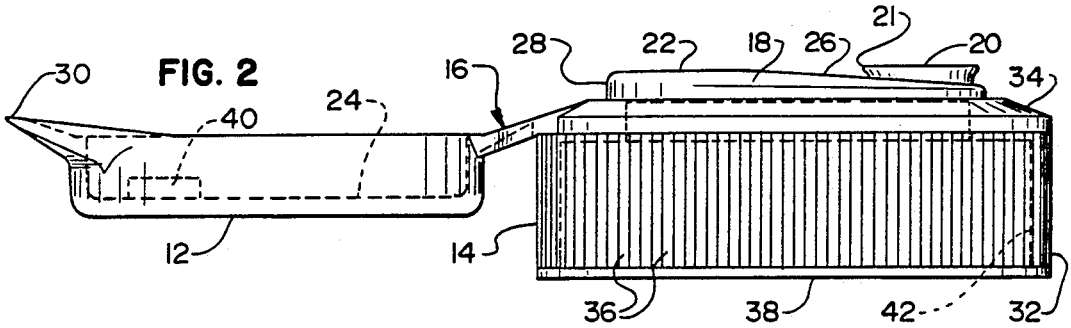
FIG. 2 is a side elevational view of the closure of FIG. 1.
Figure 5:
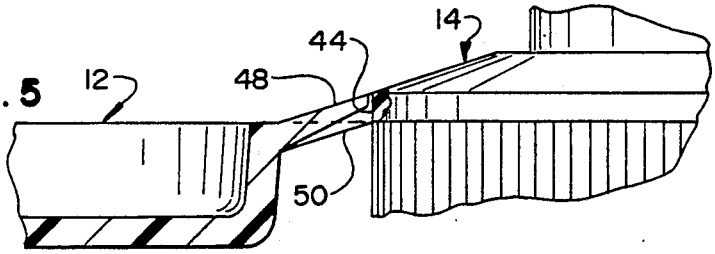
FIG. 5 is a sectional view taken along line 5—5 of FIG. 1, in the direction indicated generally.
Figure 5A:
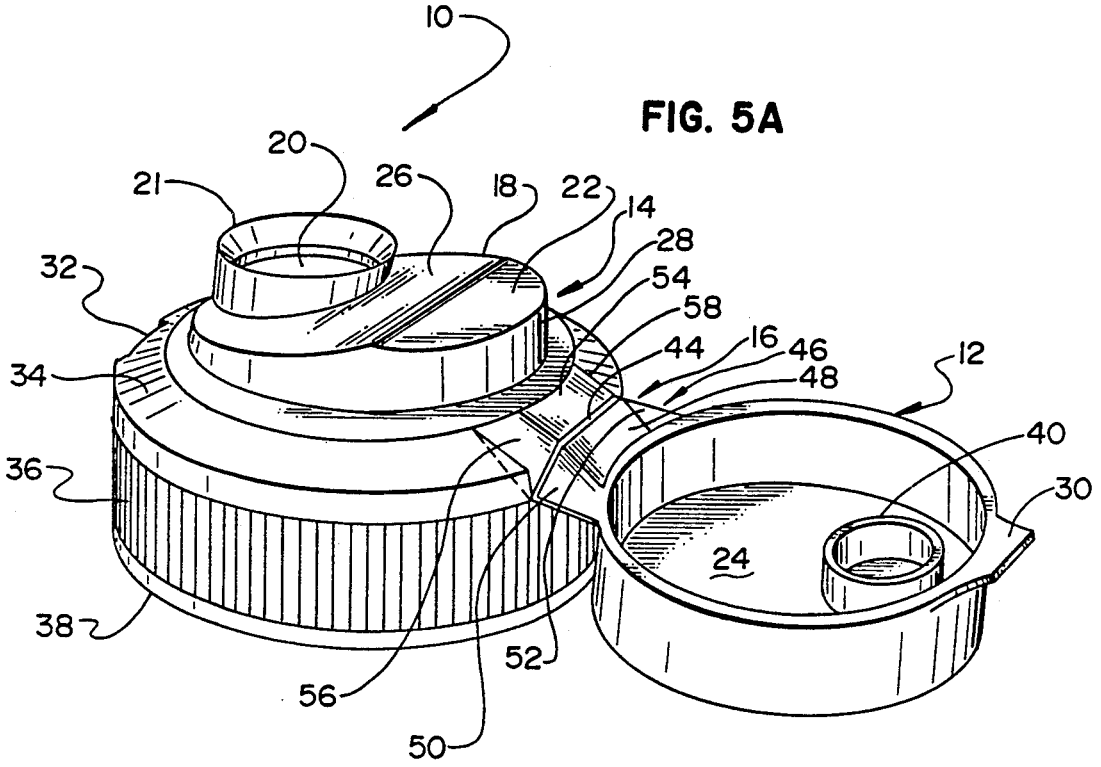
FIG. 5A, is a perspective view of the hinge closure of FIG. 1 shown in open position.
Figure 5B:
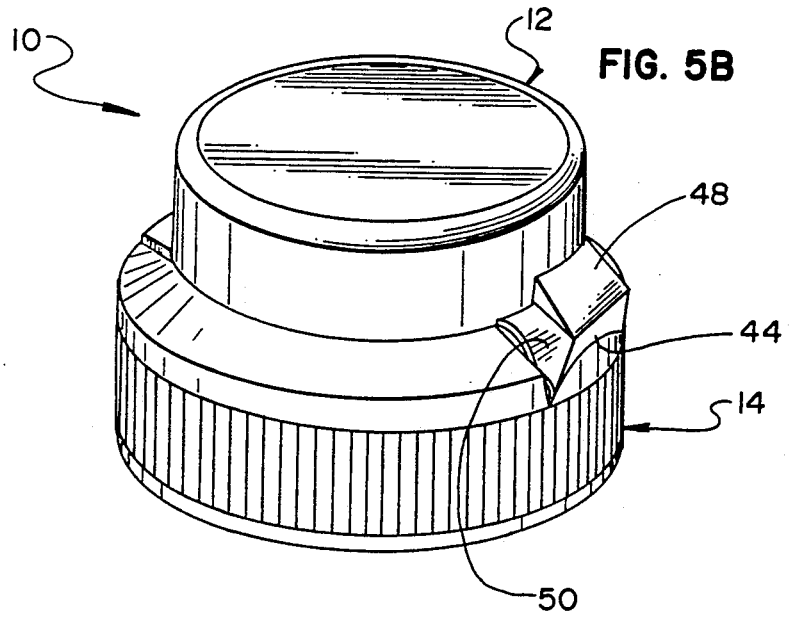
FIG. 5B is a perspective view of the hinge closure of FIG. 1 shown in closed position.
Figure 6:
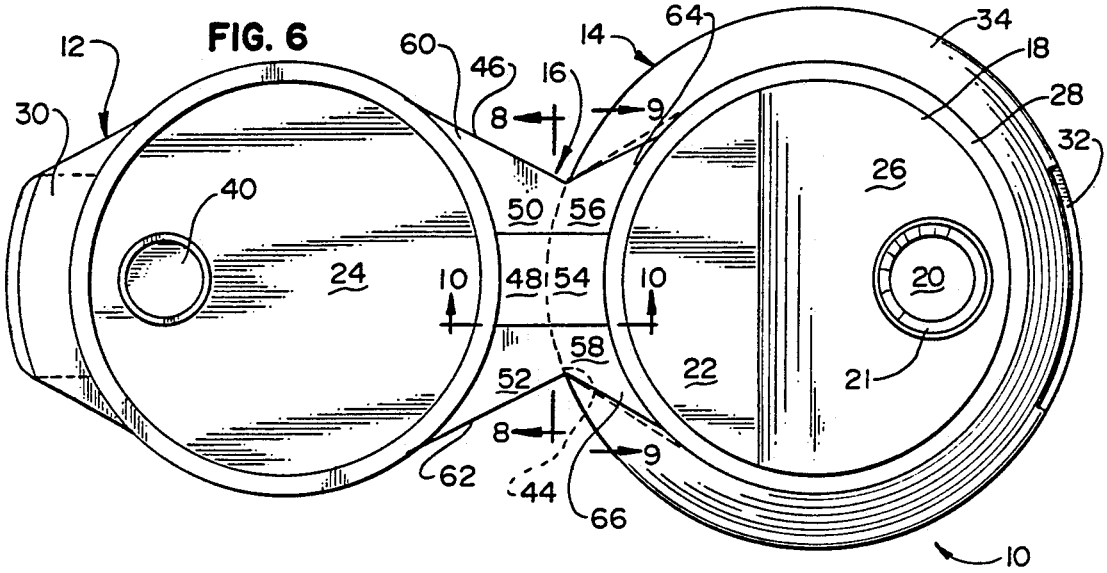
FIG. 6 is a top plan view of another embodiment of a hinge closure of the invention shown in open position.
Figure 7:
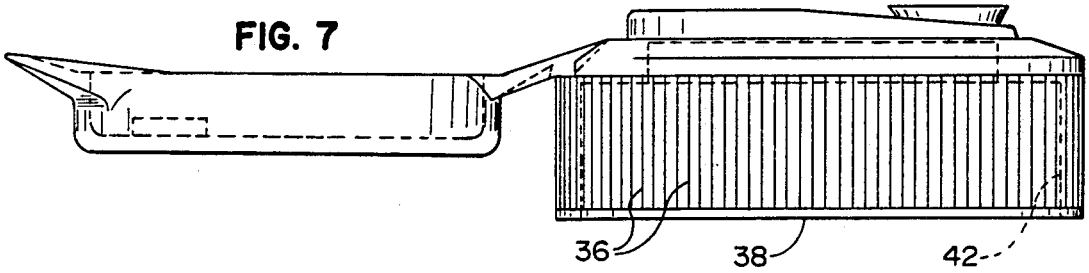
FIG. 7 is a side elevational view of the closure of FIG. 6.
Figure 8:
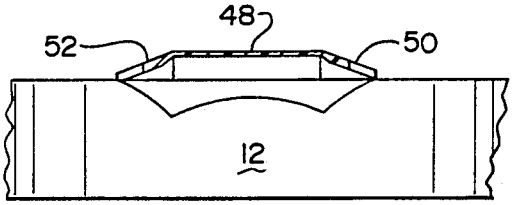
FIG. 8 is a sectional view taken along line 8—8 of FIG. 6, in the direction indicated generally.
Figure 9:
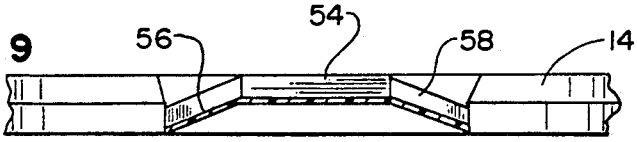
FIG. 9 is a sectional view taken along line 9—9 of FIG. 6, in the direction indicated generally.
Figure 10:
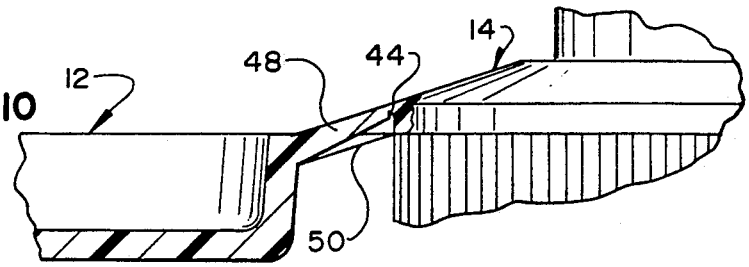
FIG. 10 is a sectional view taken along line 10—10 of FIG. 6, in the direction indicated generally.
Figure 10A:
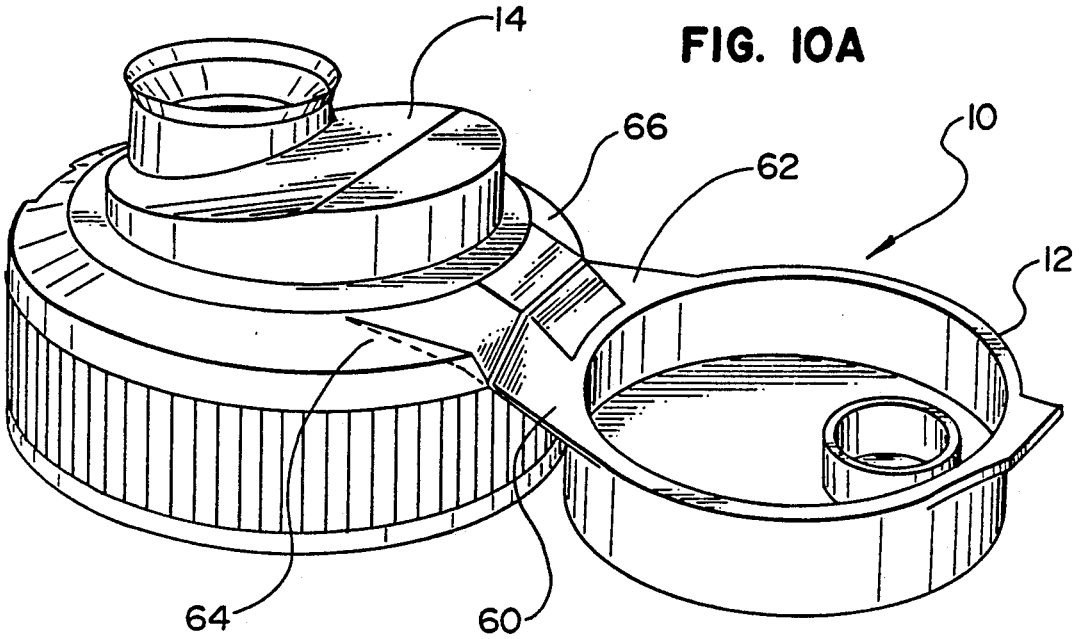
FIG. 10A is a perspective view of the hinge closure of FIG. 6 shown in open position.
Figure 10B:
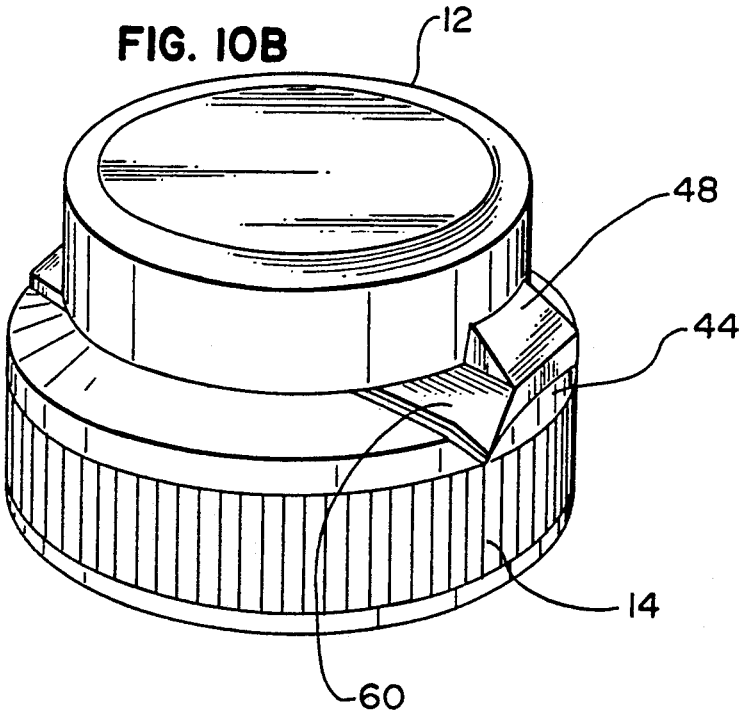
FIG. 10B is a perspective view of the hinge closure of FIG. 6 shown in closed position.

Referring to FIGS. 1, 2 and 5A, an embodiment of the hinge closure of the invention is designated generally by the reference numeral 10. The closure 10 includes a hinged lid 12 and a cap body 14, preferably formed in one piece, which can be molded from a strong resilient plastic, such as polypropylene. The lid 12 includes a unitary hinge 16 formed to shield the hinge area to inhibit contamination and minimize any product seepage between the lid 12 and the cap body 14 when the lid 12 is closed, as illustrated in FIG. 5B, and provide a snap action as will be described herein.

The cap body 14 includes a raised upper wall or top portion 18 having a dispensing opening 20 therethrough. The opening 20 can be countersunk and include an outwardly flared spout portion 21. The top portion 18 includes a first planar portion 22 which is designed to provide a minimal clearance between the surface thereof and a bottom wall 24 of the lid 12 when the lid 12 is closed. The clearance can be, for example, on the order of 0.010 inches ( 0.254 mm) but can vary. The top portion 18 includes a second inclined or ramp portion 26 which provides clearance for fluid to be expelled as the lid 12 is closed and clearance for the lid 12 to be securely snap closed over a periphery 28 of the top portion 18. The upper surface of the ramp portion 26 preferably is below the top of the dispensing opening 20.

To assist in opening the lid 12, which can be securely snapped shut over the periphery 28, the lid 12 preferably includes a lift tab extension 30. The lift tab extension 30 extends over a facet 32, which can be curved or flat, formed in the cap body 14.

The cap body 14 additionally includes a ramp or sloped peripheral perimeter shoulder 34 below the top portion 18 which further aids in preventing water or other contaminants from seeping under the closed lid 12. The cap body 14 preferably includes a plurality of finger ridges 36 around a side wall 38 to aid in securing and removing the closure 10 on a dispensing container (not illustrated). The lid 12 includes a plugging structure 40 which depends from the inside of the bottom wall 24 to mate with the inside of the opening 20 to close the opening 20 when the lid 12 is closed. As FIG. 2 illustrates, the cap body 14 preferably includes a plurality of inner threads 42 to enable the closure 10 to be secured to the top of a dispensing container.

The hinge 16 is designed to provide a minimal amount of clearance space to inhibit contamination and reduce seepage between the hinge 16, the lid 12 and the cap body 14 when the lid 12 is closed, as illustrated in FIG. 5B, while still providing a snap opening hinge 16. Accordingly, as FIGS. 1 and 5A illustrate, the hinge 16 includes a hinge joint or film hinge 44 adjacent the side wall 38 of the cap body 14. A hinge member or arm 46 connects the hinge 16 to the lid 12. The hinge arm 46 includes a central planar portion 48 integrally formed with a first depending side shoulder 50 and a second depending side shoulder 52.

In order to reduce seepage space between the lid 12 and the body 14 when the lid 12 is closed, the central planar portion 48 of the hinge arm 46 is designed to mate against a complementary planar portion or ramp 54 formed in the shoulder 34 of the cap body 14. Furthermore, to assist in reducing any seepage around the hinge 16, the shoulder 34 can include a complementary groove 56 and a complementary groove 58, one each formed on either side of the ramp 54. When the lid 12 is closed, the side shoulders 50 and 52 seat within the grooves 56 and 58 respectively. This hinge construction inhibits contamination and reduces any seepage around the hinge 16 when the hinge closure 10 is closed and fitted onto a container and simultaneously provides the desired snap open feature of the hinge closure 10.

The snap open feature of the hinge closure 10 will now be explained in greater detail. When the lid 12 is in its open position as illustrated in FIGS. 1, 2 and 5A, the central planar portion 48 and the first and second side shoulders 50 and 52 of the hinge arm 46 depend at a slight downward angle with respect to the hinge joint 44. Additionally, as described hereinabove, the side shoulders 50 and 52 depend downwardly from opposite sides of the central planar portion 48. The planar ramp 54 and complementary grooves 56 and 58 of the cap body 14, however, are formed with a slight upward angle with respect to the hinge joint 44.

Upon rotation of the lid 12 to its closed position illustrated in FIG. 5B, the central planar portion 48 and the first and second side shoulders 50 and 52 of the hinge arm 46 begin to rotate about the hinge joint 44. At a position intermediate the open and closed position of the lid 12, a "snap" occurs within the hinge 16. More specifically, the side shoulders 50 and 52 shift to a position where the side shoulders 50 and 52 are upstanding with respect to the central planar portion 48. Accordingly, this provides the desired snap action or over-center feature in the side shoulders 50 and 52 at a position exterior to the lid 12 and cap body 14. This snap action also enables proper mating between the central planar portion 48 and the planar ramp 54 as well as between the side shoulders 50 and 52 and the complementary grooves 56 and 58.

Figure 3:
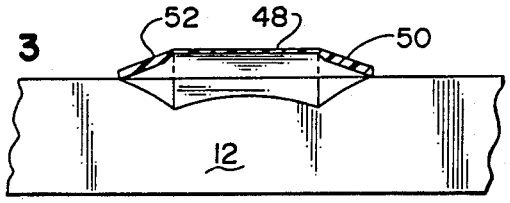
FIG. 3 is a sectional view taken along the line 3—3 of FIG. 1, in the direction indicated generally.
Figure 4:
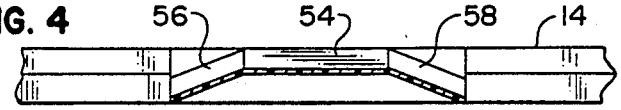
FIG. 4 is a sectional view taken along line 4—4 of FIG. 1, in the direction indicated generally.

As FIG. 5 illustrates, the thickness of the central planar portion 48 is slightly tapered having its thicker portion proximate the lid 12 and its thinner portion proximate the hinge joint 44. As FIG. 3 illustrates, the side shoulders 50 and 52 are formed with a substantially constant thickness along their lengths which is relatively thin compared to the thickness of the central planar portion 48 proximate the lid 12. This enables the central planar portion 48 to rotate about the hinge joint 44 while the side shoulders 50 and 52 rotate and shift to provide the snap action as described above.

FIGS. 6–10 illustrate another embodiment of the hinge closure 10 where common elements are referred to by the same numerals. To further assist in shielding the hinge closure 10, the slide shoulders 50 and 52 can be widened to include tapered web portions 60 and 62 respectively. Upon closing of the lid 12, the webs 60 and 62 mate with corresponding recesses 64 and 66, one each formed in the cap body 14 on opposite sides of the grooves 56 and 58. The webs 60 and 62 provide increased shielding of the hinge closure 10 and assist in providing the desired snap action at a position exterior to the lid 12 and cap body 14. It is to be noted that the webs 60 and 62 can be formed as smooth extensions of the side shoulders 50 and 52.

Figure 11:
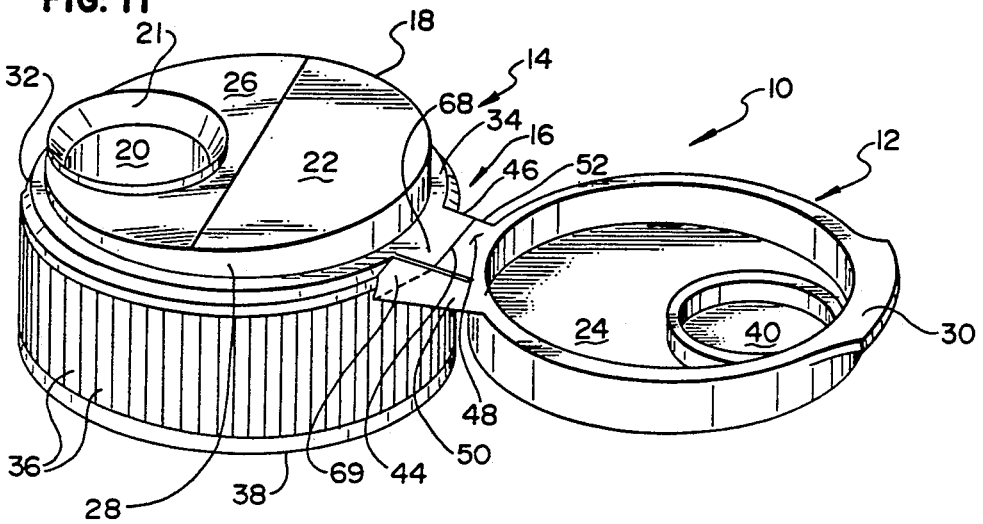
FIG. 11 is a perspective view of another embodiment of a hinge closure of the invention shown in open position.
Figure 12:
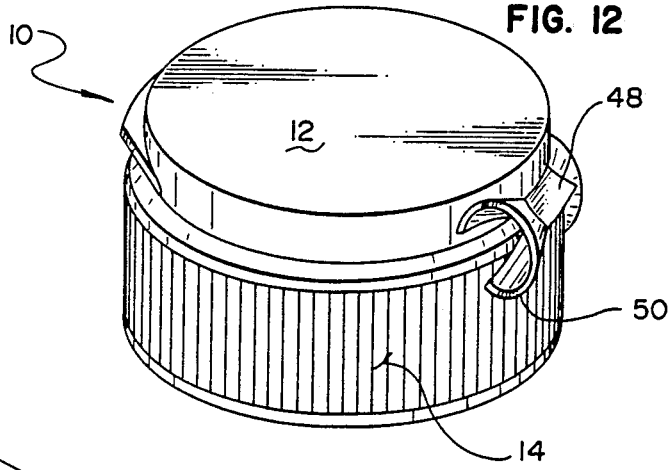
FIG. 12 is a perspective view of the hinge closure of FIG. 11 in closed position.
Figure 13:
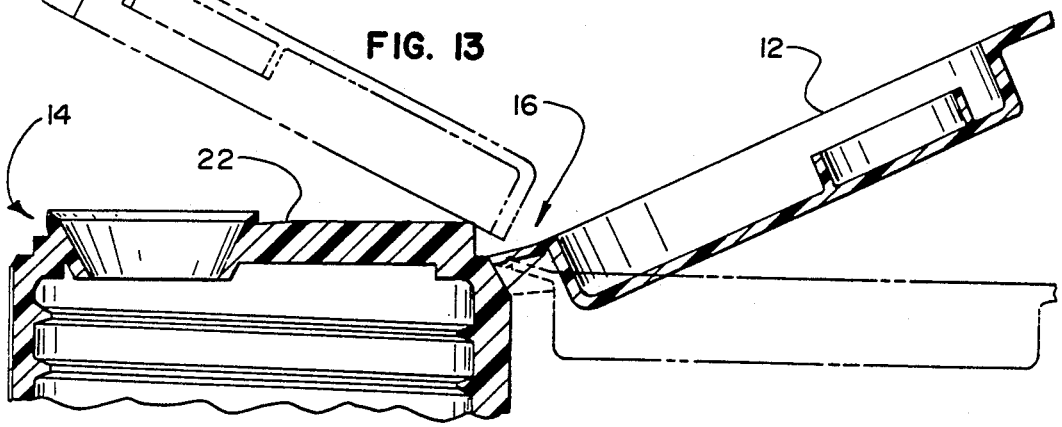
FIG. 13 is a side sectional view of the hinge closure of FIG. 11 illustrating a position intermediate the open and partially closed positions which are shown in dotted outline.

FIGS. 11–13 illustrate another embodiment of the hinge closure 10 where again, common elements are referred to by the same numerals. In this embodiment, the planar ramp 54 and grooves 56 and 58 of the cap body 14 are replaced with a planar shelf 68 supported by a supporting member 69. The hinge joint 44 is positioned a pre-determined distance outward from the side wall 38 of the cap body 14. The depending side shoulders 50 and 52 extend from the lid 12 past the hinge joint 44 to the cap body 14. Accordingly, upon closing of the lid 12, the hinge closure 10 assumes the configuration illustrated in FIG. 12 thereby shielding the hinge closure 10 exterior to the lid 12 and cap body 14 while providing the desired snap action.

As FIG. 13 illustrates, when the closure 10 is first formed, the lid 12, as shown in the right side dotted outline, is in a plane slightly below but generally parallel to the plane including the first planar portion 22 of the top portion 18 of the cap body 14. When the closure 10 is utilized, the depending side shoulders 50 and 52 are slightly stretched, resulting in two positions of the lid 12. One position is shown in solid outline and represents the dispensing position of the lid 12. The other position is shown in the left side dotted outline and represents the partially closed position of the lid 12. When the lid 12 is in this partially closed position it readily can be moved to the fully closed position where it snaps over the periphery 28 of the top portion 18 of the cap body 14. It is to be understood that all embodiments of the closure 10 can be formed in this manner.

Figure 14:
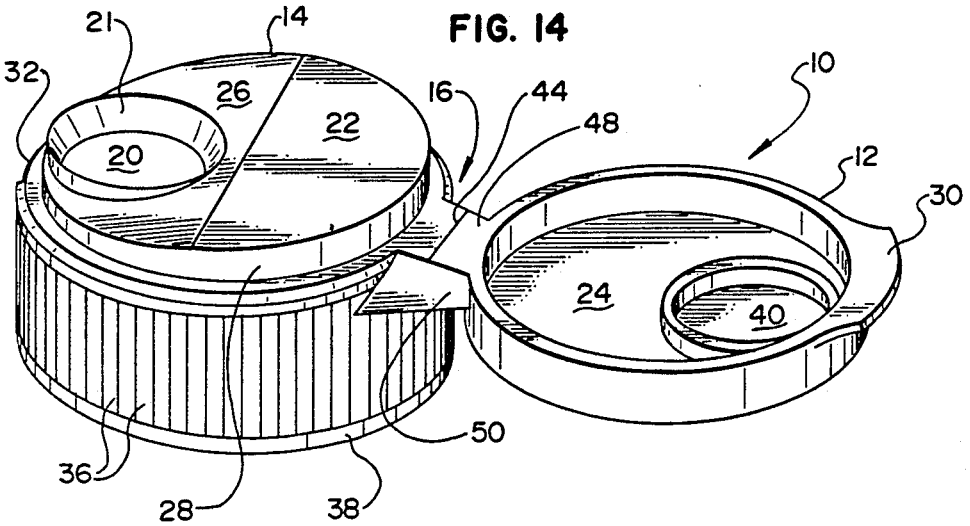
FIG. 14 is a perspective view of another embodiment of a hinge closure of the invention shown in open position.
Figure 15:
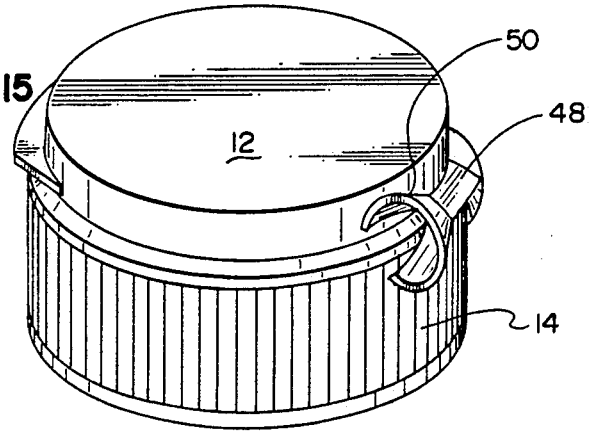
FIG. 15 is a perspective view of the hinge closure of FIG. 14 shown in closed position.
Figure 16:
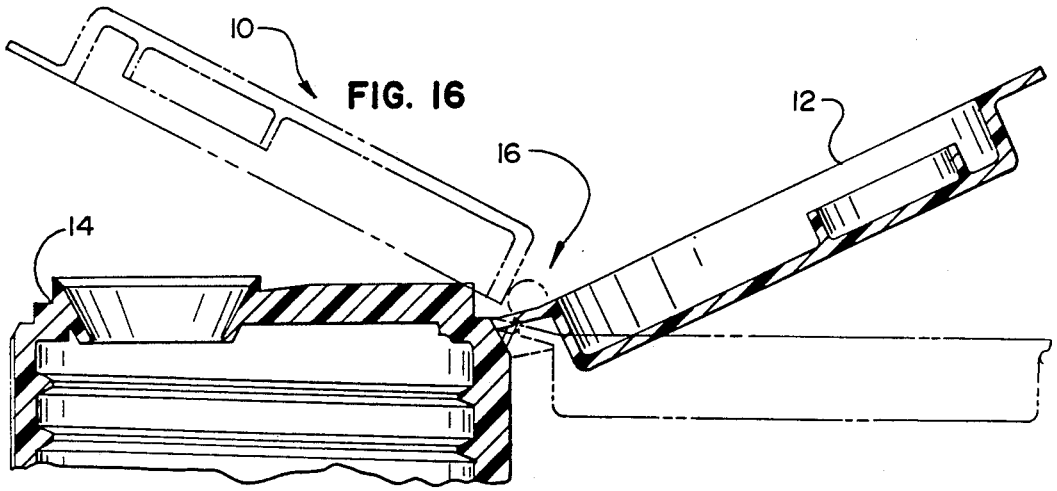
FIG. 16 is a side sectional view of the hinge closure of FIG. 14 illustrating a position intermediate the open and partially closed positions which are shown in dotted outline.

FIGS. 14–16 illustrate another embodiment of the hinge closure 10 where common elements are referred to by the same numerals. The hinge closure 10 of this embodiment is similar to the hinge closure 10 of the embodiment of FIGS. 11–13 except the first and second side shoulders 50 and 52 are angled slightly inward as they extend toward the lid 12 and flare outward as they extend toward the cap body 14. Accordingly, upon closing of the lid 12, the hinge closure 10 assumes the configuration illustrated in FIG. 15, thereby shielding the hinge closure 10 exterior to the lid 12 and cap body 14 while providing the desired snap action. FIG. 16 illustrates the orientation of the lid 12 in its several positions, similar to that of the description of FIG. 13.

Figure 17:
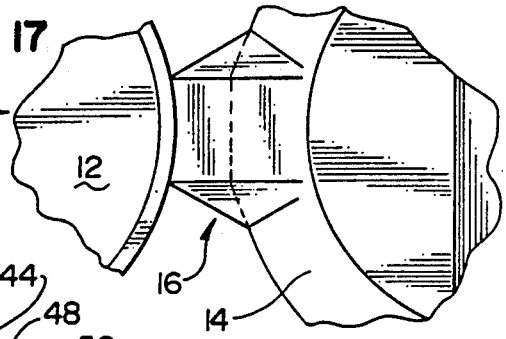
FIG. 17 is a partial top plan view of another embodiment of the hinge closure of the invention shown in open position.
Figure 18:
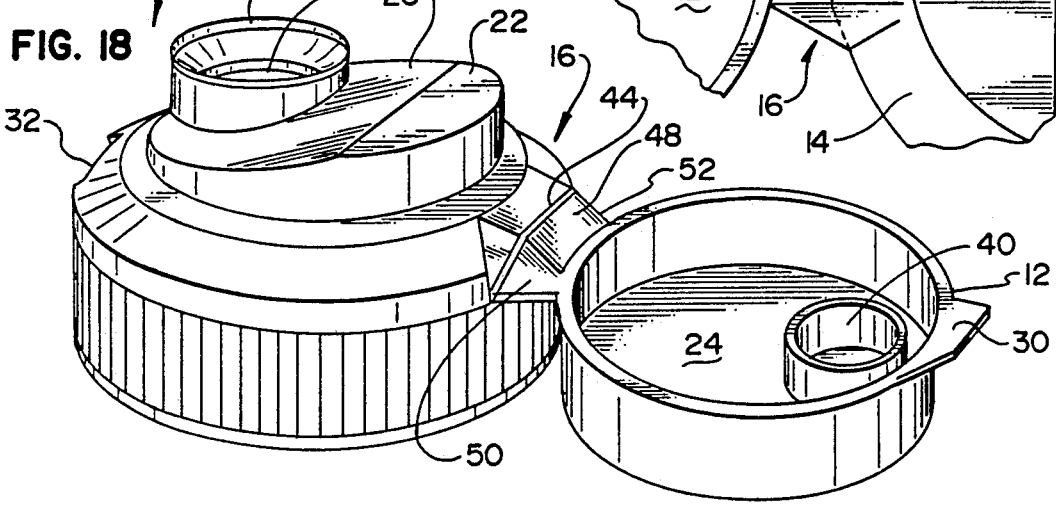
FIG. 18 is a perspective view of the hinge closure of FIG. 17.
Figure 19:
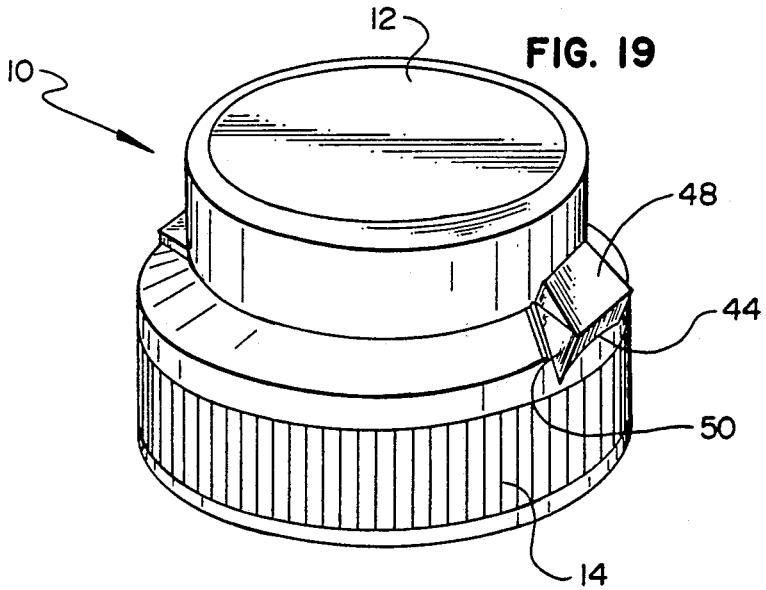
FIG. 19 is a perspective view of the hinge closure of FIG. 17 shown in closed position.

FIGS. 17–19 illustrate another embodiment of the hinge closure 10 where common elements are referred to by the same numerals. In this embodiment, the depending side shoulders 50 and 52 are angled slightly inward as they extend toward the lid 12 and flare outward as they extend toward the cap body 14, but still terminate at the hinge joint 44 on the side wall 38 of the cap body 14. Accordingly, upon closing of the lid 12, the hinge closure 10 assumes the configuration illustrated in FIG. 19, thereby providing the desired shielding and snap action to the hinge closure 10.

Modifications and variations of the present invention are possible in light of the above teachings. It is therefore to be understood that within the scope of the appended claims, the invention may be practiced otherwise than as specifically described.

What is claimed and desired to be secured by Letters Patent of the United States is:

1. A hinge closure comprising:

a cap body portion adapted to be secured to a container having a dispensing opening therein, said cap body portion including a top portion raised above a shoulder and including a periphery therearound, said cap body including a mating portion;

a lid hinged to said cap body by a solid one-piece unitary hinge member integrally formed between said cap body and said lid, said hinge member being attached on one side directly to said lid and on an opposite side to said cap body by a film hinge and including a central planar portion; and said hinge member including a side shoulder depending from either side of said central planar portion of said hinge member when said lid is in its opened position and being attached on one end directly to said lid and on an opposite end to said cap body by said film hinge so that a snap is provided in said side shoulders during operation of said hinge member and said side shoulders mate with said mating portion of said cap body in a closed position of said lid.

2. The closure as defined in claim 1 wherein said mating portion includes a ramp portion for mating with said central planar portion of said hinge member when said lid is in the closed position.

3. The closure as defined in claim 1 wherein said lid extends in a plane generally parallel to a plane including said top portion of said cap body at a position below said shoulder of said cap body when said lid is positioned in its fully opened position.

4. The closure as defined in claim 1 wherein said snap is provided in said side shoulders to position said lid in a partially closed position proximate said top portion of said cap body by rotating said lid about said hinge member toward said cap body to flex said side shoulders into an opposite upstanding position with respect to said central planar portion.

5. The closure as defined in claim 4 wherein said snap is provided in said side shoulders to position said lid away from said top surface of said cap body by rotating said lid about said hinge member away from said cap body to flex said side shoulders to their original depending positions.

6. The closure as defined in claim 1 wherein said mating portion of said cap body extends outwardly from said cap body portion and said side shoulders mate with said mating portion at a position external to said body portion.

7. The closure as defined in claim 1 wherein said mating portion is formed in said shoulder of said body portion and said side shoulders mate with said mating portion at a position within the confines of said body portion.

8. A unitary shielded snap type hinge closure comprising:

a cap body portion adapted to be secured to a container having a dispensing opening therein, said cap body portion including a top portion raised above a shoulder and including a periphery therearound, said shoulder including a ramp portion having a groove positioned on either side thereof;

a lid hinged to said cap body by a solid one-piece unitary hinge member integrally formed between said cap body and said lid, said hinge member being external to said cap body portion and being attached on one side directly to said lid and or an opposite side to said cap body by a film hinge and including a central planar portion complimentary with said cap body ramp portion and designed to abut said ramp portion when said lid is closed; and said hinge member including a side shoulder depending from either side of said central planar portion of said hinge member when said lid is in its opened position and being attached on one end directly to said lid and on an opposite end to said cap body by said film hinge so that a snap closure is provided in said side shoulders of said hinge member during closing of said cap to position said lid proximate said top portion of said cap body portion by rotating said lid about said hinge member toward said cap body to flex said depending side shoulders into an opposite upstanding position with respect to said central planar portion where said side shoulders can seat within said grooves of said cap body ramp portion when said lid is in the closed position, and a snap opening is provided in said side shoulders to position said lid away from said top surface of said cap body by rotating said lid about said hinge member away from said cap body to flex said side shoulders to their original depending positions.

9. The closure as defined in claim 8 wherein said lid extends in a plane generally parallel to a plane including said top portion of said cap body at a position below said shoulder of said cap body when said lid is positioned in its fully opened position.

10. The closure as defined in claim 8 wherein said mating portion is formed in said shoulder of said body portion and said side shoulders mate with said mating portion at a position within the confines of said body portion.

11. The closure as defined in claim 10 wherein said side shoulders have a substantially constant thickness and extend substantially in a straight line between said cap body portion and said lid.

12. The closure as defined in claim 10 wherein said side shoulders include a tapered web portion and said mating portion of said cap body portion is constructed to correspond with said tapered web portions of said side shoulders.

13. The closure as defined in claim 10 wherein said side shoulders are angled slightly inward as they extend toward said lid and flare outward as they extend toward said cap body portion.

14. The closure as defined in claim 8 wherein said mating portion of said cap body extends outwardly from said cap body portion at a position external to said body portion.

15. The closure as defined in claim 14 wherein said planar ramp portion of said cap body portion includes a planar shelf supported outwardly from said cap body portion by a supporting member, said film hinge being positioned a predetermined distance outward from said cap body portion and said side shoulders extending from said lid past said film hinge to engage directly said cap body portion.

16. The closure as defined in claim 15 wherein said side shoulders are angled slightly inward as they extend toward said lid and flare outward as they extend toward said cap body portion.

* * * * *